US009892686B2

(12) United States Patent
Xu et al.

(10) Patent No.: US 9,892,686 B2
(45) Date of Patent: Feb. 13, 2018

(54) AMOLED IR DROP COMPENSATION SYSTEM AND METHOD

(71) Applicant: Shenzhen China Star Optoelectronics Technology Co., Ltd., Shenzhen (CN)

(72) Inventors: Jing Xu, Shenzhen (CN); Taijiun Hwang, Shenzhen (CN)

(73) Assignee: SHENZHEN CHINA STAR OPTOELECTRONICS TECHNOLOGY CO., LTD., Shenzhen, Guangdong (CN)

( * ) Notice: Subject to any disclaimer, the term of this patent is extended or adjusted under 35 U.S.C. 154(b) by 99 days.

(21) Appl. No.: 14/781,307

(22) PCT Filed: Jul. 1, 2015

(86) PCT No.: PCT/CN2015/083068

§ 371 (c)(1),
(2) Date: Sep. 30, 2015

(87) PCT Pub. No.: WO2016/201735

PCT Pub. Date: Dec. 22, 2016

(65) Prior Publication Data

US 2017/0140705 A1 May 18, 2017

(30) Foreign Application Priority Data

Jun. 16, 2015 (CN) ..... 2015 1 0334833

(51) Int. Cl.
*G09G 3/20* (2006.01)
*G09G 3/3258* (2016.01)

(52) U.S. Cl.
CPC ..... *G09G 3/3258* (2013.01); *G09G 3/2003* (2013.01); *G09G 2300/0452* (2013.01);
(Continued)

(58) Field of Classification Search
CPC ..... G09G 3/3258; G09G 3/2003; G09G 2300/0452; G09G 2320/0233;
(Continued)

(56) References Cited

U.S. PATENT DOCUMENTS

2004/0183483 A1* 9/2004 Inoue ..... G09G 3/3233 315/366
2005/0134534 A1* 6/2005 Yamada ..... G09G 3/22 345/63
(Continued)

FOREIGN PATENT DOCUMENTS

WO WO2014071343 A1 5/2014

*Primary Examiner* — Sejoon Ahn
(74) *Attorney, Agent, or Firm* — Leong C. Lei

(57) ABSTRACT

The present invention provides an AMOLED IR drop compensation system and method. The AMOLED IR drop compensation system includes an AMOLED display panel that is divided into a plurality of zones, an image detection module, a data signal correction module, and an IR drop compensation module and may achieve zone-wise linear compensation for IR drop. The AMOLED IR drop compensation method includes dividing an AMOLED display panel in a direction of extension of a power line into a plurality of zones, applying an image detection module to detect a data signal of an image to be displayed and determine if the image to be displayed is a pure color image, applying a data correction module to convert the data signal of a pure color image to be displayed, and applying an IR drop compensation module to conduct zone-wise linear IR drop compensation for each of the plurality of zones by adjusting the variation of the data signal of each of the sub-pixels of each of the zones of the AMOLED display panel. The present invention can effectively compensate IR drop and overcome the problem of the image quality being not homogeneous caused by IR drop when an AMOLED display panel is displaying a pure color image.

4 Claims, 6 Drawing Sheets

(52) U.S. Cl.
CPC ..... *G09G 2320/0233* (2013.01); *G09G 2320/0276* (2013.01); *G09G 2320/0673* (2013.01); *G09G 2330/021* (2013.01)

(58) Field of Classification Search
CPC ... G09G 2320/0276; G09G 2320/0673; G09G 2330/021
See application file for complete search history.

(56) References Cited

U.S. PATENT DOCUMENTS

| | | | | |
|---|---|---|---|---|
| 2015/0187280 | A1* | 7/2015 | Park | G09G 3/3291 345/691 |
| 2015/0294612 | A1* | 10/2015 | Kim | G09G 3/3225 345/690 |
| 2016/0117982 | A1* | 4/2016 | Fujii | G09G 3/3225 345/211 |

* cited by examiner

AMOLED IR DROP COMPENSATION SYSTEM AND METHOD

BACKGROUND OF THE INVENTION

1. Field of the Invention

The present invention relates to the field of display technology, and in particular to an active matrix organic light-emitting diode (AMOLED) IR drop compensation system and method.

2. The Related Arts

Organic light emitting diode (OLED) display devices have various advantages, including being self-luminous, low driving voltage, high luminous efficiency, short response time, high resolution and contrast, approximately 180 degree view angle, wide operation temperature range, and being capable of flexible displaying and large-area full-color displaying, and is thus considered one of the display devices that have the most prosperous future.

The OLED display devices can be classified in two types, which are passive matrix OLED (PMOLED) and active matrix OLED (AMOLED), namely direct addressing and thin-film transistor (TFT) matrix addressing, according to how it is driven. The AMOLED comprises pixels arranged in an array and is a type that actively displays, having high luminous efficiency, and is commonly used in high-definition large-sized display devices. The light emission units of the AMOLED are each independently controlled through TFT addressing. The light emission unit and the TFT addressing circuit collectively form a pixel structure that is driven by being loaded with a direct-current source voltage (OVDD) through a power signal line.

FIG. 1 is a schematic view illustrating a structure of a large-sized AMOLED display device. The AMOLED display device comprises a display panel 1, a power line L for transmission of a source voltage OVDD, an Xboard 3, and a flexible printed circuit (FPC) 4. As shown in FIG. 2, pixel driving circuits associated with n pixels are connected, one by one, to the power line L that transmits the source voltage OVDD, where n is a positive integer greater than one, and each of the pixel driving circuits comprises a typical 2T1C structure, which comprises a switch thin-film transistor T1, a driving thin-film transistor T2, a storage capacitor C, and an organic light-emitting diode D. In an ideal condition, the impedance of the power line L for the transmission of the source voltage OVDD can be neglected, meaning no IR drop occurs during the transmission of the source voltage VODD and the electrical current I that flows through each pixel driving circuit is identical in the display of a pure color and consequently, the brightness of the OLEDs of all areas should be identical, providing excellent homogeneity.

However, as shown in FIG. 3, in an actual condition, there is inevitably impedance existing along the power line L for transmission of the source voltage OVDD and IR drop is induced by the source voltage VODD transmitted along the power line L. With the sizes of the AMOLED display panels getting larger and the resolution becoming greater, the length of the power line L is increased and the impedance increased. Reference being had to FIG. 1, the level of the source voltage at location that is close to the FPC 4 and thus the site where the power is fed in is higher than that at a location distant from the site where the power is fed in.

Under the assumption that the impedance of the power line L associated with the ith pixel driving circuit is $R_i$, where i=1, 2, 3, . . . , n, and the electrical current flowing through the ith pixel driving circuit is $I_i$, the level of source voltage associated with the ith pixel is $OVDD_i$, which can be calculated with the following formula:

$$OVDD_i = OVDD_{i-1} - (\Sigma_{m=i}^{m=n} I_m) R_i$$

Following the direction in which the electrical current flows, the voltage division resulting from impedance of the power line L is greater at a location that is more rearward. Eventually, the source voltage $OVDD_i$ applied to the OLED is decreased with the sequence of arrangement of the n pixels. In displaying a pure color, since the electrical current $I_i$ that flows through the ith pixel driving circuit is related to the source voltage $OVDD_i$, different pixels have different outputs of electrical current, leading to different levels of brightness at different areas of a display panel so that the image homogeneity is poor and the displayed image quality is affected.

SUMMARY OF THE INVENTION

An object of the present invention is to provide an active matrix organic light-emitting diode (AMOLED) IR drop compensation system, which effectively compensates the IR drop and overcomes the problem of the image quality being not homogeneous caused by IR drop when an AMOLED display panel is displaying a pure color image.

Another object of the present invention is to provide an AMOLED IR drop compensation method, which effectively compensates the IR drop and overcomes the problem of the image quality being not homogeneous caused by IR drop when an AMOLED display panel is displaying a pure color image.

To achieve the above objects, the present invention provides an AMOLED IR drop compensation system, which comprises an AMOLED display panel, an image detection module, a data signal correction module, and an IR drop compensation module;

the AMOLED display panel comprising at least a power line and n sub-pixels connected, in sequence, to the power line, each of the sub-pixels comprising a pixel driving circuit, the AMOLED display panel being divided, in a direction of extension of the power line, into j zones and each of the zones accordingly comprising n/j sub-pixels, where n and j are each a positive integer greater than 1 and n≥j;

the image detection module being operable to detect a data signal of an image to be displayed and determine if the image to be displayed is a pure color image, and feed the data signal of the pure color image to be displayed to the data correction module;

the data correction module receiving the data signal of the pure color image to be displayed and conducting conversion of the data signal of the pure color image to be displayed;

the IR drop compensation module receiving the data signal of the pure color image to be displayed that has been converted by the data correction module and adjusting a variation of the data signal of each of the n/j sub-pixels of each of the zones of the AMOLED display panel to achieve zone-wise linear compensation of IR drop for each of the j zones.

The IR drop compensation module performs an algorithm for zone-wise linear compensation of IR drop for each of the j zones as follows:

firstly, the impedance of the power line being divided into n levels corresponding to the n sub-pixels connected in sequence to the power line;

the n levels of the impedance being separated into j segments corresponding to the j zones of the AMOLED display panel, wherein the first segment is closest to a reference source voltage and the jth segment is furthest from the reference source voltage;

in a coordinate system in which the abscissa axis stands for the levels of the impedance and IR drop is the ordinate axis, nodes corresponding to a boundary of each of the segments and the associated IR drop $\Delta OVDD_i$ being plotted, where i=1, 2, . . . , j, and a line being drawn to connect every two adjacent ones of the nodes to obtain linear ratio $K_i$ between IR drop and the impedance level of each of the segments:

$$K_i=(\Delta OVDD_i-\Delta OVDD_{i-1})/(n/j)$$

based on the linear ratio $K_i$ between IR drop and the impedance level of each of the segments, the IR drop corresponding to each impedance level of each segment being calculated, wherein assuming $((i-1)n/j)<m<i(n/j)$, the IR drop $\Delta OVDD_m$ corresponding to the mth impedance level of the ith segment is:

$$\Delta OVDD_m=\Delta OVDD_{i-1}+K_i(m-(i-1)n/j))$$

finally, zone-wise linear compensation being conducted for the j zones and the variation of data signal, $\Delta VData_m$, of the mth sub-pixel of the ith zone of the AMOLED display panel is adjusted according to $\Delta OVDD_m$ that is calculated for the mth impedance level of the ith segment:

$$\Delta VData_m=\Delta OVDD_m.$$

The AMOLED IR drop compensation system further comprises a frame rate control module or a dithering display module.

The data signal correction module uses a GAMMA curve to convert the data signal of a pure color image to be displayed from 8 bits to 10 bits.

The power line extends in a vertical direction and the AMOLED display panel is divided in the vertical direction into the j zones; alternatively, the power line extends in a horizontal direction and the AMOLED display panel is divided in the horizontal direction into the j zones.

The present invention also provides an AMOLEDIR drop compensation system, which comprises an AMOLED display panel, an image detection module, a data signal correction module, and an IR drop compensation module;

the AMOLED display panel comprising at least a power line and n sub-pixels connected, in sequence, to the power line, each of the sub-pixels comprising a pixel driving circuit, the AMOLED display panel being divided, in a direction of extension of the power line, into j zones and each of the zones accordingly comprising n/j sub-pixels, where n and j are each a positive integer greater than 1 and $n\geq j$;

the image detection module being operable to detect a data signal of an image to be displayed and determine if the image to be displayed is a pure color image, and feed the data signal of the pure color image to be displayed to the data correction module;

the data correction module receiving the data signal of the pure color image to be displayed and conducting conversion of the data signal of the pure color image to be displayed;

the IR drop compensation module receiving the data signal of the pure color image to be displayed that has been converted by the data correction module and adjusting a variation of the data signal of each of the n/j sub-pixels of each of the zones of the AMOLED display panel to achieve zone-wise linear compensation of IR drop for each of the j zones;

wherein the IR drop compensation module performs an algorithm for zone-wise linear compensation of IR drop for each of the j zones as follows:

firstly, the impedance of the power line being divided into n levels corresponding to the n sub-pixels connected in sequence to the power line;

the n levels of the impedance being separated into j segments corresponding to the j zones of the AMOLED display panel, wherein the first segment is closest to a reference source voltage and the jth segment is furthest from the reference source voltage;

in a coordinate system in which the abscissa axis stands for the levels of the impedance and IR drop is the ordinate axis, nodes corresponding to a boundary of each of the segments and the associated IR drop $\Delta OVDD_i$ being plotted, where i=1, 2, . . . , j, and a line being drawn to connect every two adjacent ones of the nodes to obtain linear ratio $K_i$ between IR drop and the impedance level of each of the segments:

$$K_i=(\Delta OVDD_i-\Delta OVDD_{i-1})/(n/j)$$

based on the linear ratio $K_i$ between IR drop and the impedance level of each of the segments, the IR drop corresponding to each impedance level of each segment being calculated, wherein assuming $((i-1)n/j)<m<i(n/j)$, the IR drop $\Delta OVDD_m$ corresponding to the mth impedance level of the ith segment is:

$$\Delta OVDD_m=\Delta OVDD_{i-1}+K_i(m-(i-1)n/j))$$

finally, zone-wise linear compensation being conducted for the j zones and the variation of data signal, $\Delta VData_m$, of the mth sub-pixel of the ith zone of the AMOLED display panel is adjusted according to $\Delta OVDD_m$ that is calculated for the mth impedance level of the ith segment:

$$\Delta VData_m=\Delta OVDD_m;$$

further comprising a frame rate control module or a dithering display module; and wherein the data signal correction module uses a GAMMA curve to convert the data signal of a pure color image to be displayed from 8 bits to 10 bits.

The present invention further provides an AMOLEDIR drop compensation method, which comprises the following steps:

Step 1: providing an AMOLED IR drop compensation system;

wherein the AMOLED IR drop compensation system comprises an AMOLED display panel, an image detection module, a data signal correction module, and an IR drop compensation module; and the AMOLED display panel comprises at least a power line and n sub-pixels connected, in sequence, to the power line, each of the sub-pixels comprising a pixel driving circuit, the AMOLED display panel being divided, in a direction of extension of the power line, into j zones and each of the zones accordingly comprising n/j sub-pixels, where n and j are each a positive integer greater than 1 and $n\geq j$;

Step 2: the image detection module detecting a data signal of an image to be displayed and determining if the image to be displayed is a pure color image, and, if yes, feeding the data signal of the pure color image to be displayed to the data correction module;

Step 3: the data correction module receiving the data signal of the pure color image to be displayed and conducting conversion of the data signal of the pure color image to be displayed; and Step 4: the IR drop compensation module receiving the data signal of the pure color image to be displayed that has been converted by the data correction module and adjusting a variation of the data signal of each of the n/j sub-pixels of each of the zones of the AMOLED display panel to achieve zone-wise linear compensation of IR drop for each of the j zones.

The AMOLED IR drop compensation system further comprise a frame rate control module or a dithering display module; the AMOLED IR drop compensation method further comprises Step 5, in which frame rate control or dithering displaying is performed through the frame rate control module or the dithering display module to further improve display quality of a pure color image.

Step 4 comprises:

Step 41: dividing impedance of the power line into n levels corresponding to the n sub-pixels connected in sequence to the power line;

Step 42: separating the n levels of the impedance into j segments corresponding to the j zones of the AMOLED display panel, wherein the first segment is closest to a reference source voltage and the jth segment is furthest from the reference source voltage;

Step 43: in a coordinate system in which the abscissa axis stands for the levels of the impedance and IR drop is the ordinate axis, plotting nodes corresponding to a boundary of each of the segments and the associated IR drop $\Delta OVDD_i$, where i=1, 2, . . . , j, and drawing a line to connect every two adjacent ones of the nodes to obtain linear ratio $K_i$ between IR drop and the impedance level of each of the segments:

$$K_i=(\Delta OVDD_i-\Delta OVDD_{i-1})/(n/j)$$

Step 44: based on the linear ratio $K_i$ between IR drop and the impedance level of each of the segments, calculating the IR drop corresponding to each impedance level of each segment, wherein assuming $((i-1)n/j)<m<i(n/j)$, the IR drop $\Delta OVDD_m$ corresponding to the mth impedance level of the ith segment is:

$$\Delta OVDD_m=\Delta OVDD_{i-1}+K_i(m-(i-1)n/j))$$

Step 45: conducting zone-wise linear compensation the j zones and the variation of data signal, $\Delta VData_m$, of the mth sub-pixel of the ith zone of the AMOLED display panel is adjusted according to $\Delta OVDD_m$ that is calculated for the mth impedance level of the ith segment:

$$\Delta VData_m=\Delta OVDD_m.$$

In Step 3, the data signal correction module uses a GAMMA to convert the data signal of a pure color image to be displayed from 8 bits to 10 bits.

In Step 1, the power line extends in a vertical direction and the AMOLED display panel is divided in the vertical direction into the j zones; alternatively, the power line extends in a horizontal direction and the AMOLED display panel is divided in the horizontal direction into the j zones.

The efficacy of the present invention is that the present invention provides an AMOLED IR drop compensation system, which comprises an AMOLED display panel that is divided into a plurality of zones, an image detection module, a data signal correction module, and an IR drop compensation module and may achieve zone-wise linear compensation for IR drop and effectively compensate the IR drop and overcome the problem of the image quality being not homogeneous caused by IR drop when an AMOLED display panel is displaying a pure color image. The present invention also provides an AMOLED IR drop compensation method, in which an AMOLED display panel is divided in a direction of extension of a power line into a plurality of zones, an image detection module is applied to detect a data signal of an image to be displayed and determine if the image to be displayed is a pure color image, and a data correction module is applied to convert the data signal of a pure color image to be displayed and an IR drop compensation module is applied to conduct zone-wise linear IR drop compensation for each of the plurality of zones by adjusting the variation of the data signal of each of the sub-pixels of each of the zones of the AMOLED display panel so as to effectively compensate the IR drop and overcome the problem of the image quality being not homogeneous caused by IR drop when an AMOLED display panel is displaying a pure color image and the algorithm is easy for simple implementation.

For better understanding of the features and technical contents of the present invention, reference will be made to the following detailed description of the present invention and the attached drawings. However, the drawings are provided for the purposes of reference and illustration and are not intended to impose limitations to the present invention.

BRIEF DESCRIPTION OF THE DRAWINGS

The technical solution, as well as other beneficial advantages, of the present invention will be apparent from the following detailed description of embodiments of the present invention, with reference to the attached drawing. In the drawing.

DETAILED DESCRIPTION OF THE PREFERRED EMBODIMENTS

To further expound the technical solution adopted in the present invention and the advantages thereof, a detailed description is given to a preferred embodiment of the present invention and the attached drawings.

Figure 1:
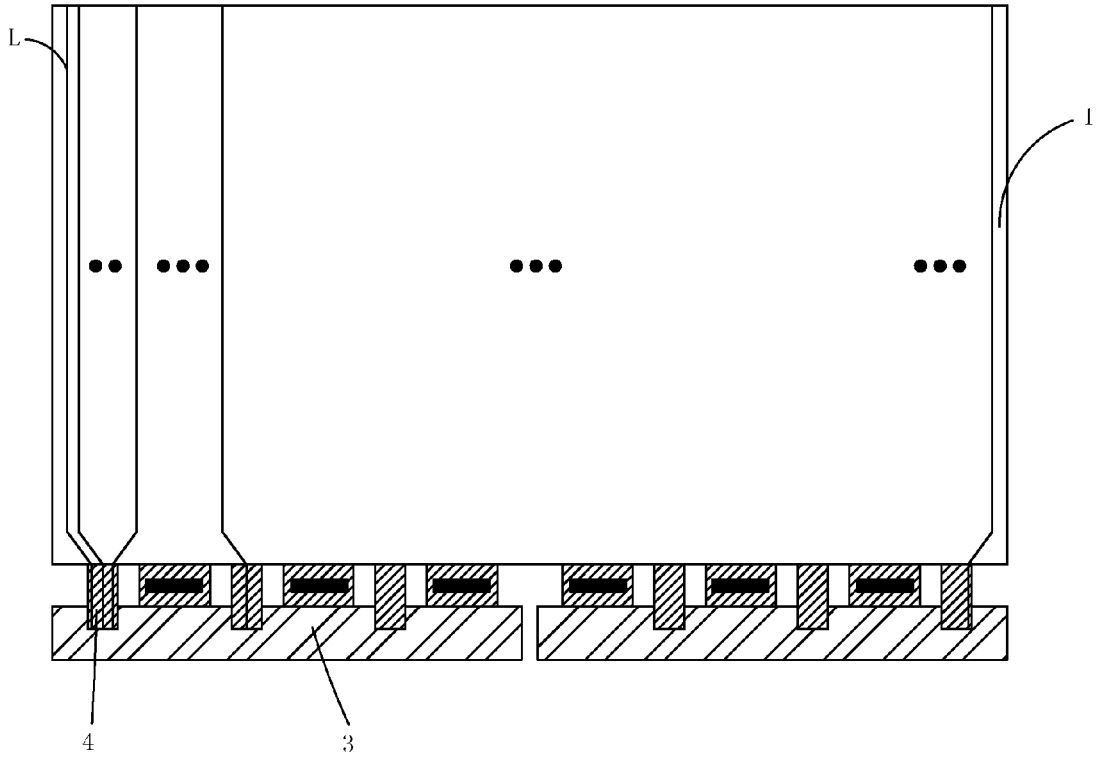
FIG. 1 is a schematic view showing a structure of a large-sized active matrix organic light emitting diode (AMOLED) display device.
Figure 2:
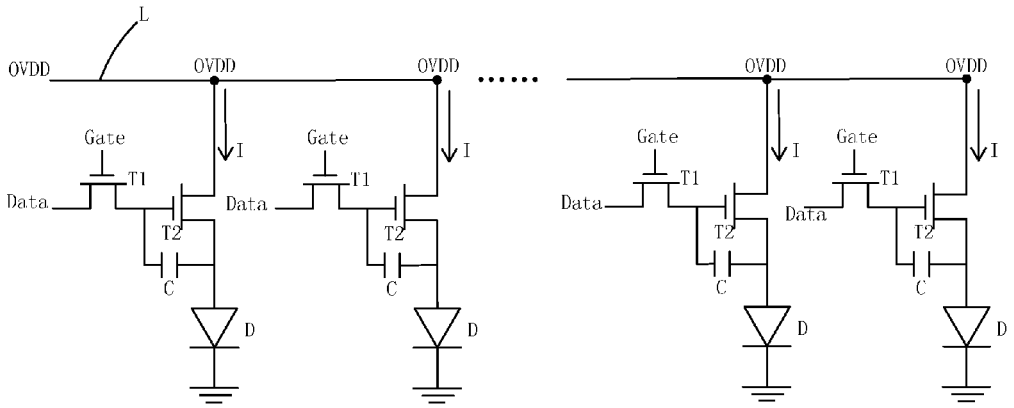
FIG. 2 is a circuit diagram of a plurality of AMOLED pixel driving circuits connected to a power line in an ideal condition.
Figure 3:
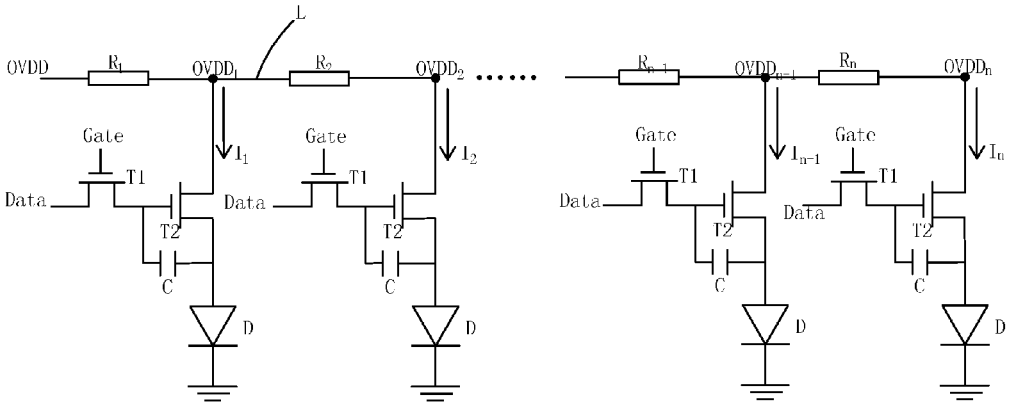
FIG. 3 is a circuit diagram of a plurality of AMOLED pixel driving circuits connected to a power line in an actual condition.
Figure 4:
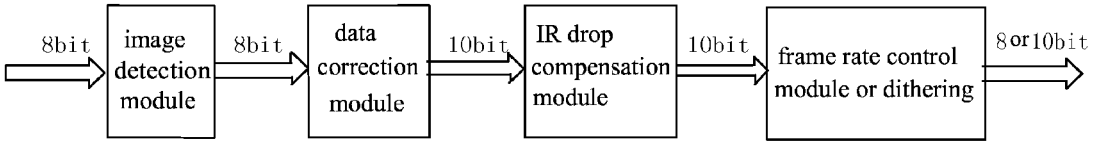
FIG. 4 is a block diagram of an AMOLED IR drop compensation system according to the present invention.
Figure 5:
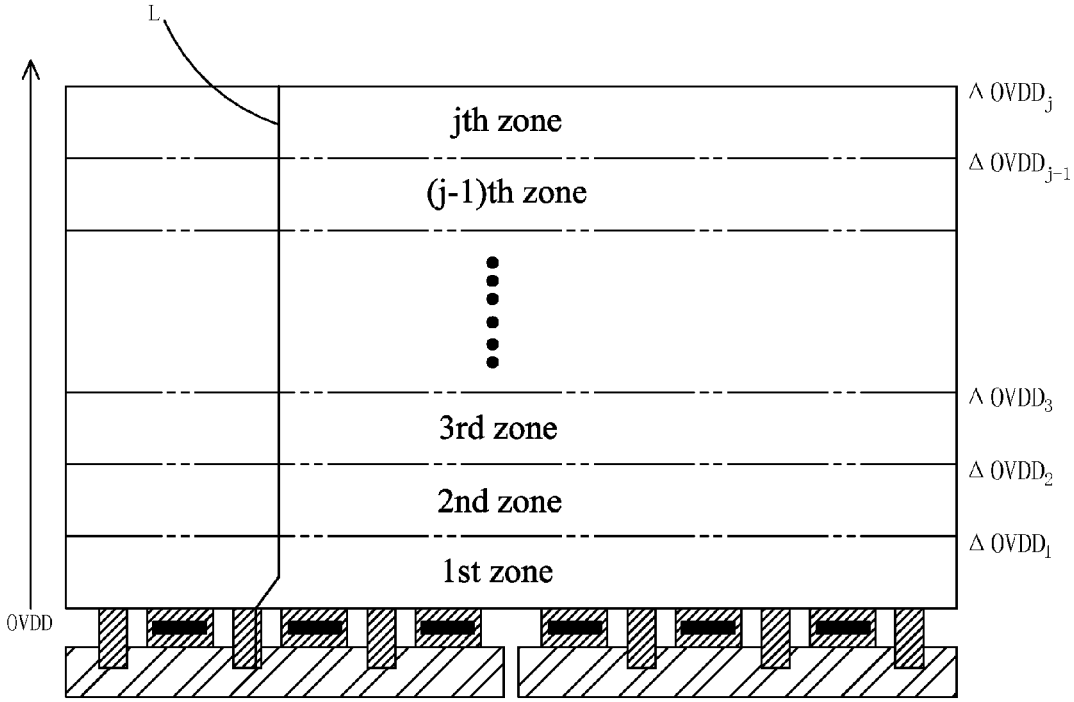
FIG. 5 is a schematic view illustrating an AMOLED display panel in which the AMOLED IR drop compensation system according to the present invention is embodied.
Figure 6:
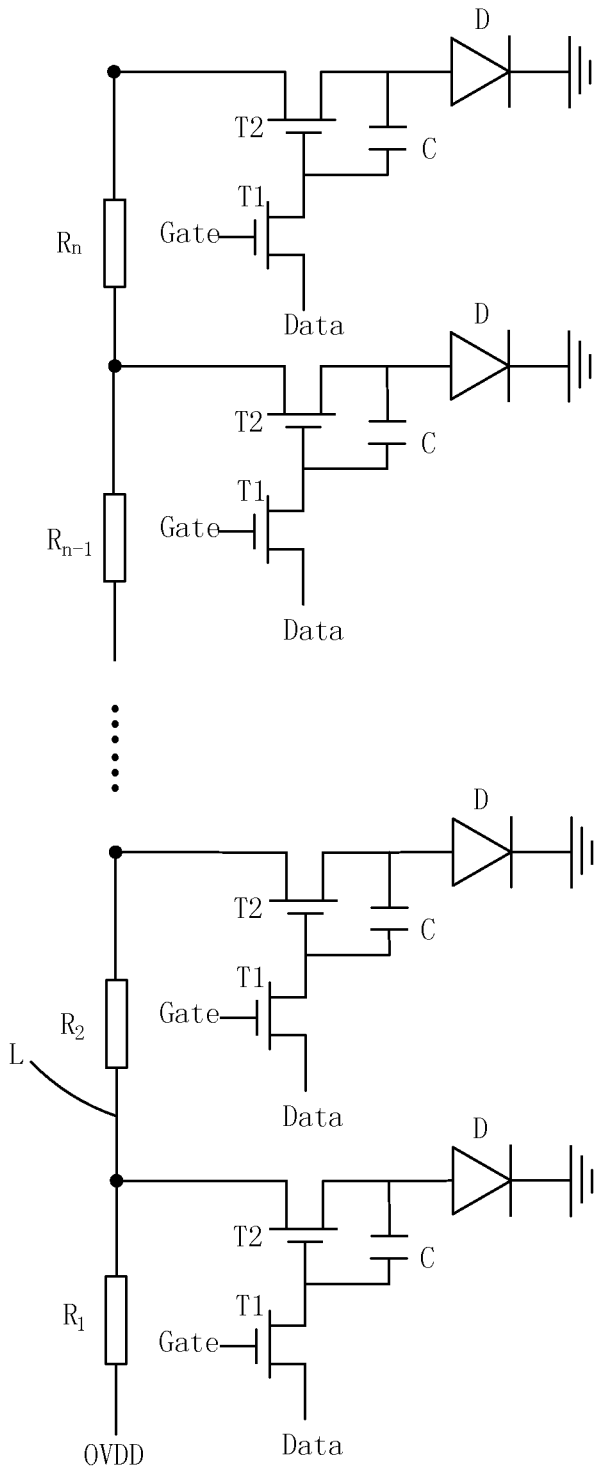
FIG. 6 is a circuit diagram of a plurality of AMOLED pixel driving circuits connected, in sequence, to a power line in the AMOLED IR drop compensation system according to the present invention.

Referring to FIGS. 4-6, firstly, the present invention provides an active matrix organic light emitting diode (AMOLED) IR drop compensation system, which comprises an AMOLED display panel, an image detection module, a data signal correction module, and an IR drop compensation module.

The AMOLED display panel comprises at least a power line L and n sub-pixels connected, in sequence, to the power line. Each of the sub-pixels comprises a pixel driving circuit. The AMOLED display panel is divided, in a direction of extension of the power line, into j zones and each of the zones accordingly comprises n/j sub-pixels, where n and j are each a positive integer greater than 1 and n≥j. Specifically, as shown in FIG. 5, if the power line L extends in a vertical direction, then the AMOLED display panel is divided into j zones in the vertical direction; and if the power line L extends in a horizontal direction, then the AMOLED display panel is divided into j zones in the horizontal direction. Further, as shown in FIG. 6, the pixel driving circuit comprises at least a switch thin-film transistor T1, a driving thin-film transistor T2, a storage capacitor C, and an organic light-emitting diode D. Taking a 2T1C structure as an example, the switch thin-film transistor T1 has a gate terminal electrically connected to a scan signal Gate, a source terminal electrically connected to a data signal Data, and a drain terminal electrically connected to a gate terminal of the driving thin-film transistor T2; the driving thin-film transistor T2 has a drain terminal electrically connected to the power line L and a source terminal electrically connected to an anode of the organic light-emitting diode D; the organic light-emitting diode D has a cathode that is grounded; the storage capacitor C has a terminal electrically connected to the drain terminal of the switch thin-film transistor T1 and an opposite terminal electrically connected to the drain terminal of the driving thin-film transistor T2.

As shown in FIG. 4, the image detection module is operable to detect a data signal of an image to be displayed and determine if the image to be displayed is a pure color image, and feed the data signal of the pure color image to be displayed to the data correction module.

The data correction module receives the data signal of the pure color image to be displayed and conducts conversion of the data signal of the pure color image to be displayed. Specifically, the data signal correction module applies a GAMMA curve to convert the data signal of the pure color image to be displayed from 8 bits to 10 bits to provide the data signal with an adjustable space.

Figure 7:
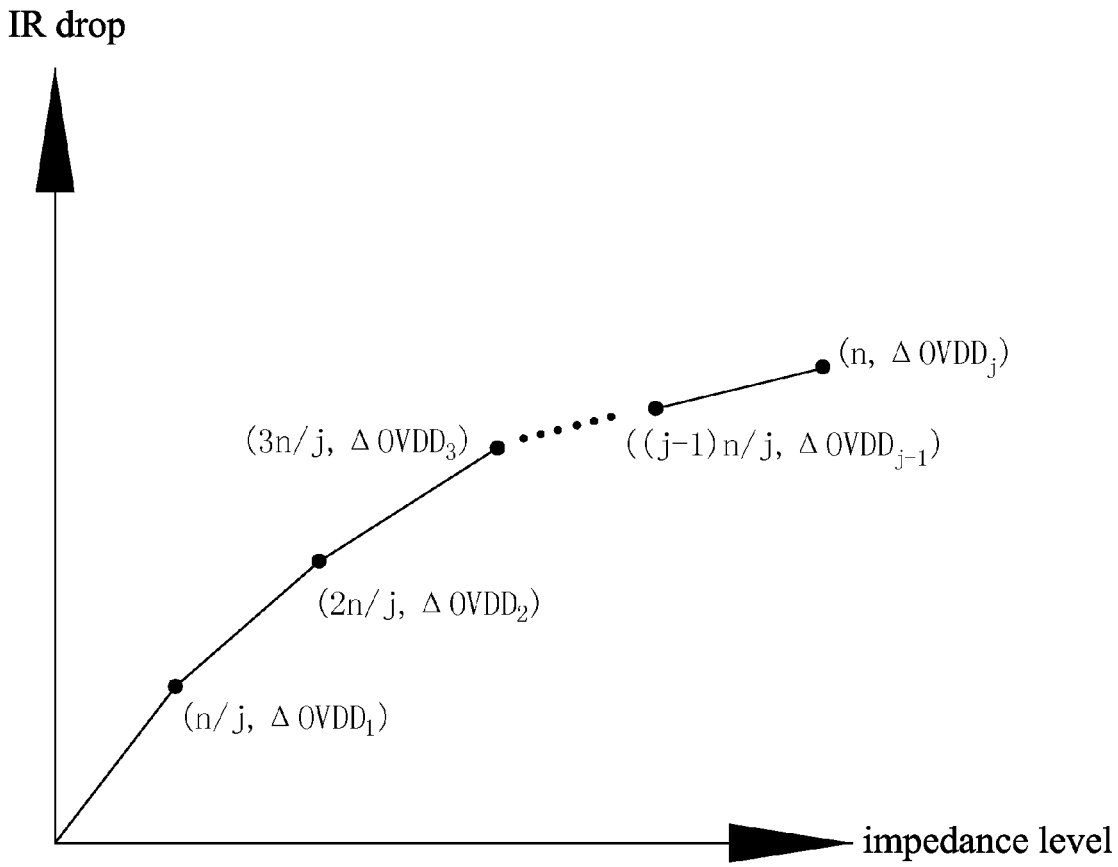
FIG. 7 is a plot showing a linear relationship between each IR drop segment used in an IR drop compensation module of the AMOLED IR drop compensation system of the present invention and impedance levels.

The IR drop compensation module receives the data signal of the pure color image to be displayed that has been converted by the data correction module and adjusts a variation of the data signal of each of the n/j sub-pixels of each of the zones of the AMOLED display panel to achieve zone-wise linear compensation of IR drop for each of the j zones. Referring additionally to FIG. 7, the IR drop compensation module performs an algorithm for zone-wise linear compensation of IR drop for each of the j zones that is as follows:

Firstly, the impedance of the power line L is divided into n levels corresponding to the n sub-pixels connected in sequence to the power line;

the n levels of the impedance are separated into j segments corresponding to the j zones of the AMOLED display panel, wherein the first segment is closest to a reference source voltage OVDD and the jth segment is furthest from the reference source voltage OVDD;

in a coordinate system in which the abscissa axis stands for the levels of the impedance and IR drop is the ordinate axis, nodes corresponding to a boundary of each of the segments and the associated IR drop ΔOVDD, are plotted, where i=1, 2, . . . , j, and a line is drawn to connect every two adjacent ones of the nodes to obtain linear ratio $K_i$ between IR drop and the impedance level of each of the segments:

$$K_i=(\Delta OVDD_i-\Delta OVDD_{i-1})/(n/j)$$

based on the linear ratio $K_i$ between IR drop and the impedance level of each of the segments, the IR drop corresponding to each impedance level of each segment is calculated, wherein assuming $((i-1)n/j)<m<i(n/j)$, the IR drop $\Delta OVDD_m$ corresponding to the mth impedance level of the ith segment is:

$$\Delta OVDD_m=\Delta OVDD_{i-1}+K_i(m-(i-1)n/j))$$

Finally, zone-wise linear compensation is conducted for the j zones and the variation of data signal, $\Delta VData_m$, of the mth sub-pixel of the ith zone of the AMOLED display panel is adjusted according to $\Delta OVDD_m$ that is calculated for the mth impedance level of the ith segment:

$$\Delta VData_m=\Delta OVDD_m.$$

To further improve the display quality of a pure color image, the AMOLED IR drop system may further comprise a frame rate control (FRC) module or a dithering display module.

The AMOLED IR drop system of the present invention may effectively compensate IR drop and overcome the problem of the image quality being not homogeneous caused by IR drop when an AMOLED display panel is displaying a pure color image.

Figure 8:
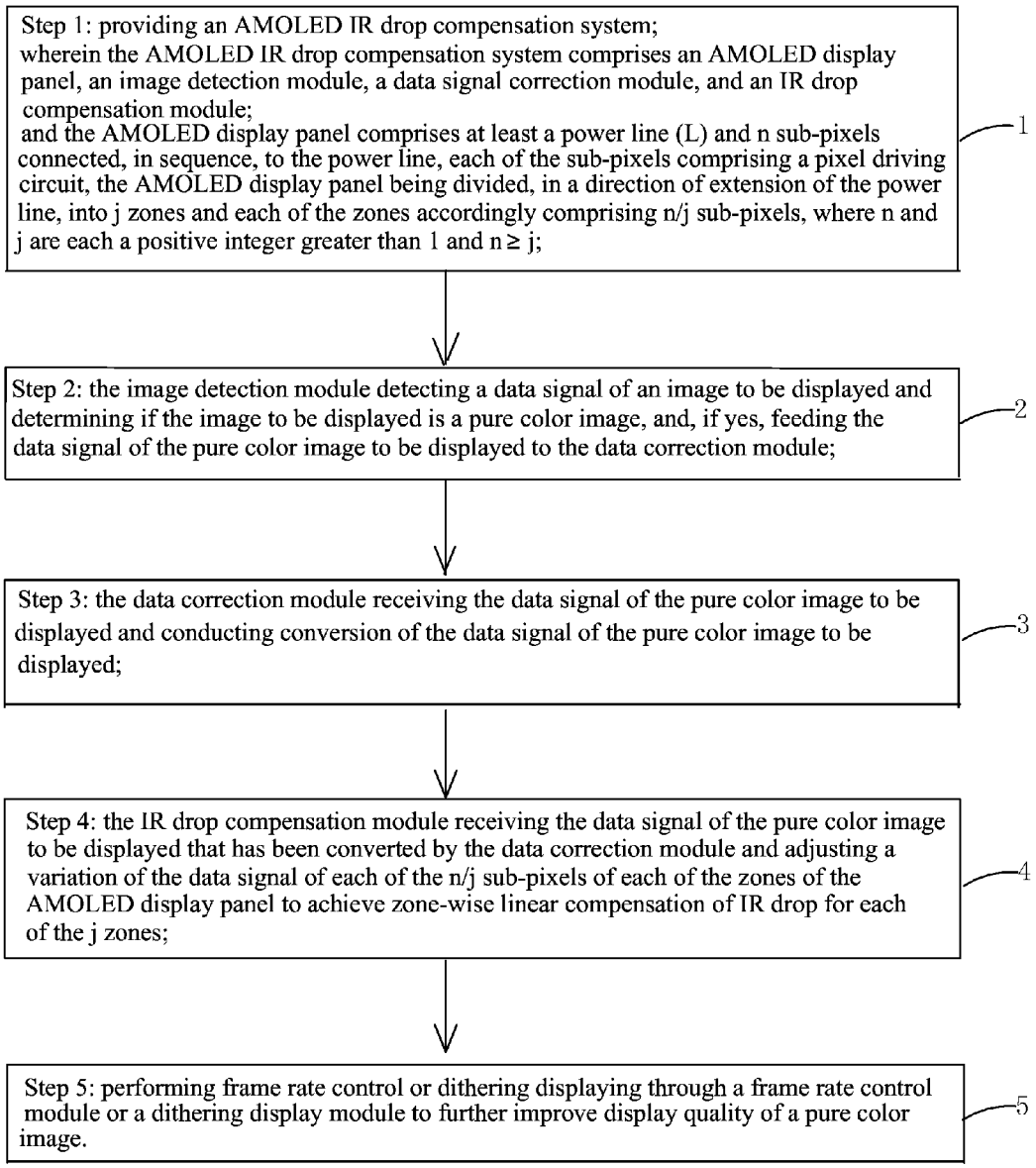
FIG. 8 is a flow chart illustrating an AMOLED IR drop compensation method according to the present invention.

Referring to FIG. 8, in combination with FIGS. 4-7, the present invention also provides an AMOLED IR drop compensation method, which comprises the following steps:

Step 1: providing an AMOLED IR drop compensation system.

As shown in FIGS. 4-6, the AMOLED IR drop compensation system comprises an AMOLED display panel, an image detection module, a data signal correction module, and an IR drop compensation module.

The AMOLED display panel comprises at least a power line L and n sub-pixels connected, in sequence, to the power line. Each of the sub-pixels comprises a pixel driving circuit. The AMOLED display panel is divided, in a direction of extension of the power line, into j zones and each of the zones accordingly comprises n/j sub-pixels, where n and j are each a positive integer greater than 1 and n≥j.

Specifically, if the power line L extends in a vertical direction, then the AMOLED display panel is divided into j zones in the vertical direction; and if the power line L extends in a horizontal direction, then the AMOLED display panel is divided into j zones in the horizontal direction.

The pixel driving circuit comprises at least a switch thin-film transistor T1, a driving thin-film transistor T2, a storage capacitor C, and an organic light-emitting diode D. Taking a 2T1C structure as an example, the switch thin-film transistor T1 has a gate terminal electrically connected to a scan signal Gate, a source terminal electrically connected to a data signal Data, and a drain terminal electrically connected to a gate terminal of the driving thin-film transistor T2; the driving thin-film transistor T2 has a drain terminal electrically connected to the power line L and a source terminal electrically connected to an anode of the organic light-emitting diode D; the organic light-emitting diode D has a cathode that is grounded; the storage capacitor C has a terminal electrically connected to the drain terminal of the switch thin-film transistor T1 and an opposite terminal electrically connected to the drain terminal of the driving thin-film transistor T2.

According practical needs of displaying, the AMOLED IR drop compensation system may further comprise a frame rate control module or a dithering display module.

Step 2: the image detection module detecting a data signal of an image to be displayed and determining if the image to be displayed is a pure color image, and, if yes, feeding the data signal of the pure color image to be displayed to the data correction module, and proceeding to Step 3.

Step 3: the data correction module receiving the data signal of the pure color image to be displayed and conducting conversion of the data signal of the pure color image to be displayed.

Specifically, in Step 3, the data signal correction module applies a GAMMA curve to convert the data signal of the pure color image to be displayed from 8 bits to 10 bits to provide the data signal with an adjustable space.

Step 4: the IR drop compensation module receiving the data signal of the pure color image to be displayed that has been converted by the data correction module and adjusting a variation of the data signal of each of the n/j sub-pixels of each of the zones of the AMOLED display panel to achieve zone-wise linear compensation of IR drop for each of the j zones.

Specifically, Step 4 comprises:

Step 41: dividing impedance of the power line L into n levels corresponding to the n sub-pixels connected in sequence to the power line;

Step 42: separating the n levels of the impedance into j segments corresponding to the j zones of the AMOLED display panel, wherein the first segment is closest to a reference source voltage OVDD and the jth segment is furthest from the reference source voltage OVDD;

Step 43: in a coordinate system in which the abscissa axis stands for the levels of the impedance and IR drop is the ordinate axis, plotting nodes corresponding to a boundary of each of the segments and the associated IR drop $\Delta OVDD_i$, where i=1, 2, . . . , j, and drawing a line to connect every two adjacent ones of the nodes to obtain linear ratio $K_i$ between IR drop and the impedance level of each of the segments:

$$K_i=(\Delta OVDD_i-\Delta OVDD_{i-1})/(n/j)$$

Step 44: based on the linear ratio $K_i$ between IR drop and the impedance level of each of the segments, calculating the IR drop corresponding to each impedance level of each segment, wherein assuming $((i-1)n/j)<m<i(n/j)$, the IR drop $\Delta OVDD_m$ corresponding to the mth impedance level of the ith segment is:

$$\Delta OVDD_m=\Delta OVDD_{i-1}+K_i(m-(i-1)n/j))$$

Step 45: conducting zone-wise linear compensation the j zones and the variation of data signal, $\Delta VData_m$, of the mth sub-pixel of the ith zone of the AMOLED display panel is adjusted according to $\Delta OVDD_m$ that is calculated for the mth impedance level of the ith segment:

$$\Delta VData_m=\Delta OVDD_m.$$

Further, the AMOLED IR drop compensation method may additionally comprises Step 5, in which frame rate control or dithering displaying is performed through a frame rate control module or a dithering display module according to bandwidth of the data signal provided by a source IC to further improve display quality of the pure color image.

It is noted that in Step 1, the more the number of the zones that the AMOLED display panel is divided is, the more accurate the compensation for IR drop will be. The number of the zones that the AMOLED display panel is divided can be determined according to the size of the actual IR drop.

The AMOLED IR drop compensation method of the present invention can effectively compensate IR drop and overcome the problem of the image quality being not homogeneous caused by IR drop when an AMOLED display panel is displaying a pure color image and the algorithm is easy for simple implementation.

In summary, the present invention provides an AMOLED IR drop compensation system, which comprises an AMOLED display panel that is divided into a plurality of zones, an image detection module, a data signal correction module, and an IR drop compensation module and may achieve zone-wise linear compensation for IR drop and effectively compensate the IR drop and overcome the problem of the image quality being not homogeneous caused by IR drop when an AMOLED display panel is displaying a pure color image. The present invention also provides an AMOLED IR drop compensation method, in which an AMOLED display panel is divided in a direction of extension of a power line into a plurality of zones, an image detection module is applied to detect a data signal of an image to be displayed and determine if the image to be displayed is a pure color image, and a data correction module is applied to convert the data signal of a pure color image to be displayed and an IR drop compensation module is applied to conduct zone-wise linear IR drop compensation for each of the plurality of zones by adjusting the variation of the data signal of each of the sub-pixels of each of the zones of the AMOLED display panel so as to effectively compensate the IR drop and overcome the problem of the image quality being not homogeneous caused by IR drop when an AMOLED display panel is displaying a pure color image and the algorithm is easy for simple implementation.

Based on the description given above, those having ordinary skills of the art may easily contemplate various changes and modifications of the technical solution and technical ideas of the present invention and all these changes and modifications are considered within the protection scope of right for the present invention.

What is claimed is:

1. An active matrix organic light emitting diode (AMOLED) voltage drop (IR drop) compensation method, comprising the following steps: Step 1: providing an AMOLED IR drop compensation system, wherein the AMOLED IR drop compensation system comprises an AMOLED display panel, which comprises at least a power line and n sub-pixels connected, in sequence, to the power line, each of the sub-pixels comprising a pixel driving circuit, the AMOLED display panel being divided, in a direction of extension of the power line, into j zones and each of the zones accordingly comprising n/j sub-pixels, where n and j are each a positive integer greater than 1 and n.gtoreq.j;

Step 2: detecting a data signal of an image to be displayed and identifying the image to be displayed as a pure color image, so as to output a data signal of the pure color image to be displayed;

Step 3: conducting conversion of the data signal of the pure color image to be displayed to generate a converted data signal; and Step 4: feeding the converted data signal through the power line to the n sub-pixels and adjusting a variation of the converted data signal of each of the n/j sub-pixels of each of the zones of the AMOLED display panel to achieve zone-wise linear compensation of IR drop for each of the j zones, wherein Step 4 comprises:

Step 41: dividing impedance of the power line into n levels corresponding to the n sub-pixels connected in sequence to the power line;

Step 42: separating the n levels of the impedance into j segments corresponding to the j zones of the AMOLED display panel, wherein the first segment is closest to a reference source voltage and the jth segment is furthest from the reference source voltage;

Step 43: in a coordinate system in which the abscissa axis stands for the levels of the impedance and IR drop is the ordinate axis, plotting nodes corresponding to a boundary of each of the segments and the associated IR drop .DELTA.OVDD.sub.i, wherein the OVDD is a direct-current source voltage, and where i=1, 2, . . . , j, and drawing a line to connect every two adjacent ones of the nodes to obtain linear ratio K.sub.i between IR drop and the impedance level of each of the segments:

*K*.sub.i=(.DELTA.OVDD.sub.i−.DELTA.OVDD.sub.i−1)/(n/j);

Step 44: based on the linear ratio K.sub.i between IR drop and the impedance level of each of the segments, calculating the IR drop corresponding to each impedance level of each segment, wherein assuming ((i−1)n/j)<m<i(n/j), the IR drop .DELTA.OVDD.sub.m corresponding to the mth impedance level of the ith segment is:

.DELTA.OVDD.sub.m=.DELTA.OVDD.sub.i−1+*K*.sub.i(m−(i−1)n/j));

Step 45: conducting zone-wise linear compensation the j zones and the variation of data signal, .DELTA.VData.sub.m, of the mth sub-pixel of the ith zone of the AMOLED display panel is adjusted according to .DELTA.OVDD.sub.m that is calculated for the mth impedance level of the ith segment:

.DELTA.*V*Data.sub.m=.DELTA.OVDD.sub.m.

2. The AMOLED IR drop compensation method as claimed in claim 1, further comprising Step 5, in which frame rate control or dithering displaying is performed to further improve display quality of the pure color image.

3. The AMOLED IR drop compensation method as claimed in claim 1, wherein in Step 3, a GAMMA curve is used in the conversion of the data signal of the pure color image to be displayed from 8 bits to 10 bits to generate the converted data signal.

4. The AMOLED IR drop compensation method as claimed in claim 1, wherein in Step 1, the power line extends in a vertical direction and the AMOLED display panel is divided in the vertical direction into the j zones; alternatively, the power line extends in a horizontal direction and the AMOLED display panel is divided in the horizontal direction into the j zones.

* * * * *